United States Patent [19]

Torre et al.

[11] 4,315,471

[45] Feb. 16, 1982

[54] WORKPIECE GUIDE FOR SEWING MACHINES

[75] Inventors: Giancarlo D. Torre, Biassono; Vittorio de Simone, Milan, both of Italy

[73] Assignee: Rockwell-Rimoldi, S.p.A., Milan, Italy

[21] Appl. No.: 171,880

[22] Filed: Jul. 24, 1980

[30] Foreign Application Priority Data

Sep. 7, 1979 [IT] Italy ..... 25530 A/79

[51] Int. Cl.[3] ..... D05B 35/10

[52] U.S. Cl. ..... 112/153; 112/DIG. 2

[58] Field of Search ..... 112/153, 150, 148, 136, 112/141, DIG. 2, DIG. 3

[56] References Cited

U.S. PATENT DOCUMENTS 2,674,023 4/1954 Foley ..... 112/DIG. 2
3,142,107 7/1964 Wittig ..... 112/DIG. 2
4,013,026 3/1977 Hall ..... 112/153
4,075,957 2/1978 Marforio ..... 112/153
4,126,097 11/1978 Willenbacher ..... 112/153

*Primary Examiner*—H. Hampton Hunter

[57] ABSTRACT

A workpiece guide for separately guiding, aligning and removing the curled edges of superposed layers of fabric to be joined by seaming in a sewing machine. The guide includes a plurality of spaced and vertically aligned plate elements forming passages therebetween for the fabric layers. The leading edges of the plate elements have a curved profile and adjacent the sewing axis these profiles are formed to extend in the direction of the sewing zone and define recesses with a configuration of bulbous outline. The edges of the plate elements forming the entrance to the recesses are tapered in the direction of their respective passages and are effective in engaging the pieces of fabric to complete the unrolling and straightening of the fabric edges as they enter their respective passage.

5 Claims, 3 Drawing Figures

WORKPIECE GUIDE FOR SEWING MACHINES

BACKGROUND OF THE INVENTION

The present invention pertains to a workpiece guide for sewing machines and particularly to a guide that is effective in removing the curling or rolling of the sides of the pieces of fabric forming the workpiece. As is well known to those conversant in the sewing art, when joining superposed layers of fabric by seaming, it is important that the edges of said layers, along which the seam is to be incorporated, be maintained in alignment even when said edges may have profiles that are not identical.

Workpiece guides for maintaining alignment of the edges of superposed layers of fabric are well known and are commonly formed by a plurality of vertically aligned plate elements which are spaced to define channels or passages therebetween and which extend in planes parallel with the worksurface of the machine. These plate elements are interconnected by a support member having a surface extending perpendicular to the machine's worksurface and which define a guide wall within each of the passages that is adapted to engage the edge of a layer of fabric and guide the same toward the stitching zone.

The number of plate elements forming a workpiece guide are governed by the number of layers of fabric which are to be joined by seaming, the consistency of the material forming the pieces of fabric, and the diversity and complexity of the edge configurations to be sewn. In particular, in a guide having a plurality of passages, the number of plate elements should be such as to form the same number of channels or passages as there are pieces of fabric to be joined so that said pieces will advance separately in the direction of the sewing zone. The ability of the workpiece guide to maintain the pieces of fabric to be joined in separation as they approach the stitching instrumentalities and at the same time cause the edges thereof to engage their respective guide wall within the guide provides the means for aligning and maintaining alignment of the edges as they enter the sewing zone. This separation between the individual pieces of fabric is necessary in order to automatically align the edges as required even though said pieces may have configurations that differ from one another. In the case of simply providing a seam along the edge of a single piece of fabric regardless of its configuration a guide may be utilized having a single passage which is enclosed by one upper plate member and the worksurface itself or by two plate members. The height of each passage should correspond to the thickness of the fabric which is inserted therein so that said fabric will be adequately spread or flattened in order that its edge will properly engage its respective guide wall. Independent advance of the separate pieces of fabric in contact with their respective guide walls provided in each passage is possible because a portion of said pieces are located beneath the presser foot of the sewing machine which cooperates with the machine's transport device or so-called feed dogs that are effective in advancing the pieces along the sewing axis.

The combined action provided by the presser foot and the feed dogs is concentrated on a limited portion of the pieces of fabric that determines a point laterally disposed relative to the sewing axis and applies a rotating force on said pieces that is effective in causing their edges to maintain engagement with their respective guide walls. Actually the effect of advancement of the pieces of fabric outwardly from the guide and sewing axis where they frictionally engage the worksurface of the machine creates a breaking action on said pieces that continually urges the edges thereof to maintain contact with their respective guide wall within said guide. The upper plate element serves to maintain the upper piece of fabric in its intended path of travel by preventing any possible displacement thereof in an upwardly direction or from becoming folded over. The intermediate plate serves the same function on the lower piece of fabric and as the respective guide walls for each piece of fabric are normally in vertical alignment, they are effective in causing the workpiece to enter the sewing zone with the edges of each piece in required alignment even though one piece may not have the same edge configuration as the other. Advancement of the fabric pieces in their respective passages by the feed dogs presents a problem when the pieces forming the workpiece are exceptionally thin and of light weight construction for the rotating force referred to above is substantially less pronounced on such fabric whereby it becomes more difficult to maintain the separate pieces in contact with their respective guide walls which, of course, results in a further problem of obtaining and maintaining adequate alignment of said edges prior to their entry into the sewing zone.

A further problem occurs in the case of knitted fabric which because of the well known structure of the fabric, any longitudinal traction applied to its edges accentuates its tendency to roll or curl over and thus change its intended shape and structure. Although the provision of braking elements such as follower clips, applied to the trailing edge of the pieces of fabric improves the operational register between the piece and its guide wall, the tendency of the edge to be sewn to curl or roll is enhanced because it is stretched and elongated to a greater extent than the remainder of the fabric.

This disadvantage is most frequently encountered when dealing with knitted fabrics which have a far greater degree of stretch than other fabrics. The developed curl or roll at the edge of the fabric to be sewn is usually rejected by the guide. In other words, the fabric develops at its edge a double or triple thickness which is such as to prevent it from passing through its respective passage in the guide or, if it manages to enter said passage, the seam would be incorrectly formed and would result in a deformity of the intended edge configuration of the sewn piece. Workpiece guides are known which are adapted to correct the rolling over condition of fabric edges before they enter the passages of said guides; however, such known guides have a structural design that is intended for vertical sewing machines only so as to influence pieces of fabric which extend and are caused to advance to the stitching instrumentalities in a vertical manner in order to provide ample clearance surrounding them. These guides are also designed so as to permit manual intervention on the part of the operator so as to effect accurate guiding of the pieces of fabric in the direction of the sewing zone. Consequently, these known types of guides are not adapted to accurately control pieces of fabric in modern sewing machines which are capable of running at high speed. Additionally, these guides would be inadequate if applied to sewing machines utilizing automatic operating cycles and especially when the workpieces are formed from pieces of fabric that are of thin and lightweight construction which are subject to curling or rolling over of the edges.

SUMMARY OF THE INVENTION

A specific object of the invention is to overcome the disadvantages described above by providing a guide which is capable of automatically straightening or unrolling the edges of the pieces of fabric prior to their entering their intended passage within the guide so that they engage their particular guide walls in the required manner to effect accurate alignment of the edges to be jointed by seaming.

The workpiece guide according to the invention includes a supporting arm which carries a plurality of spaced plate elements that extend parallel with the worksurface of the machine and the combination thereof defines passages therebetween with a guide wall within each passage for aligning and guiding separate layers of fabric in the direction of the stitching instrumentalities.

Upstream of the sewing zone the leading edge of the upper and lower plate elements have a curved profile and immediately adjacent the sewing axis, the curved profiles are formed to extend in the direction of the sewing zone so as to define recesses with a configuration of bulbous outline. The edges of the plate elements at the entrance or mouth of these recesses are tapered in the direction of the passage which they form a part of and have a compressed air device attached to and operatively associated with each of said plate elements which direct streams of air in a direction that opposes the direction of advance of the fabric pieces. The combination of these tapered edges of the plate elements and the air device associated with each provides a means for effectively straightening the rolled edges of the pieces of fabric prior to said edges entering their respective passage in the workpiece guide.

Additional objects of the present invention will become more fully apparent by reference to the appended claims and as the following detailed description proceeds in reference to the figures of drawing wherein:

DESCRIPTION OF THE PREFERRED EMBODIMENT

Figure 2:
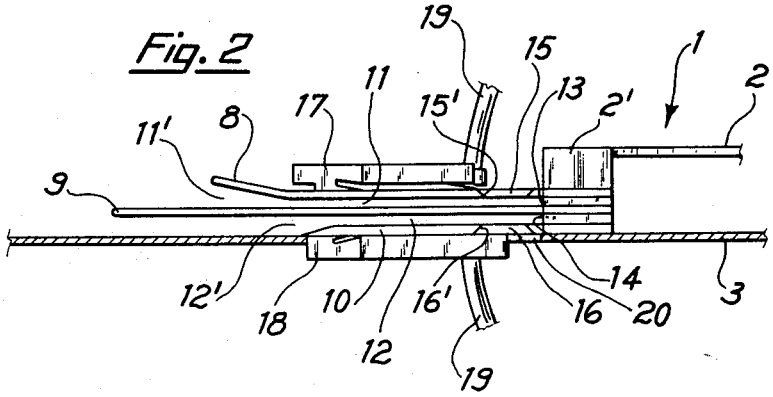
FIG. 2 is a view in front elevation of the guide as seen looking in the direction of arrows A—A in FIG. 1.
Figure 3:
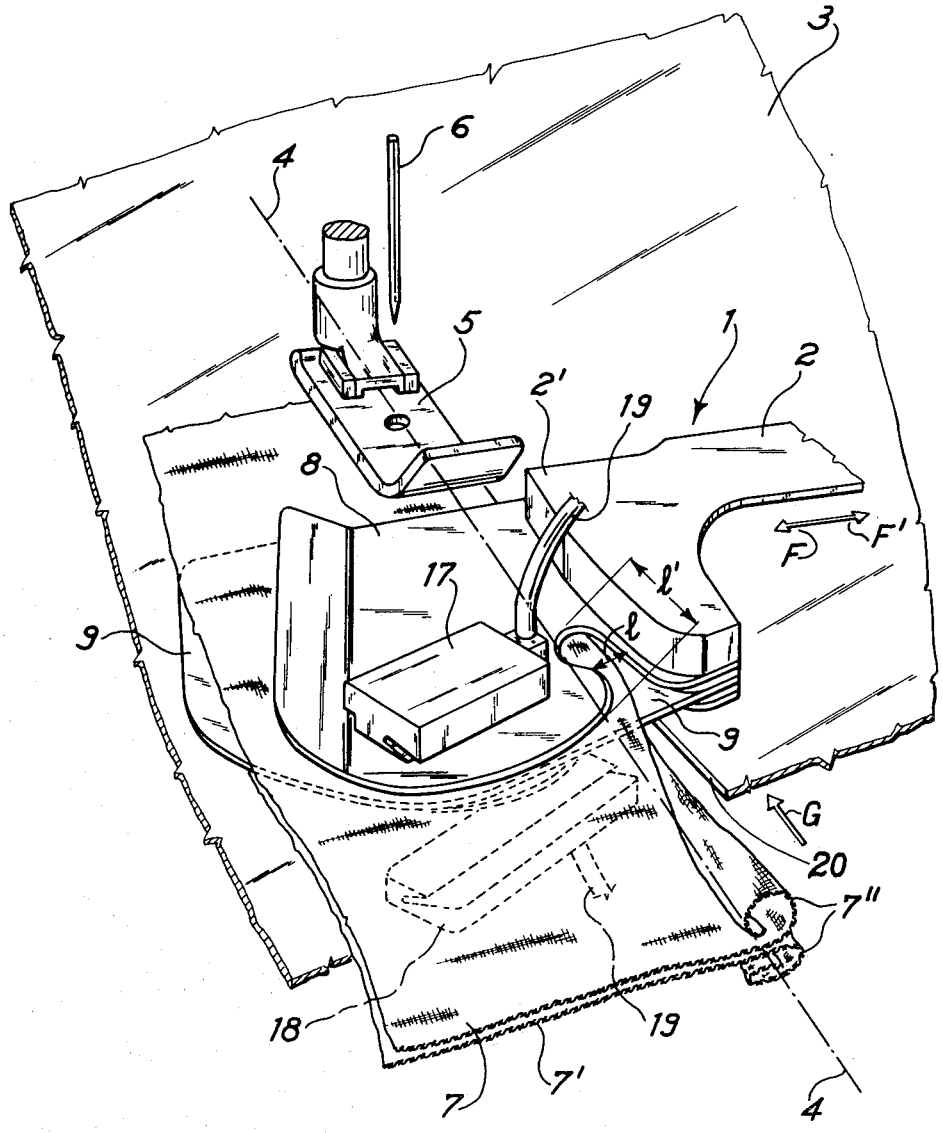
FIG. 3 is a view similar to FIG. 1 showing the guide's operating position relative to the machine's needle and presser foot.

With reference now to the drawings, the workpiece guide according to the invention is identified generally by numeral 1 and includes a supporting arm 2 located above and which extends parallel to the worksurface 3 of the sewing machine. The supporting arm 2 by any suitable means not shown, is selectively adjustable in the directions of the indicating arrows F and F' which provides a means of locating the end 2' of the supporting arm in the most desirable position relative to the sewing axis that is depicted by numeral 4. The machine's presser foot and needle are identified by numerals 5 and 6, respectively, and as shown in FIG. 3, the workpiece is formed by two separate superposed pieces of fabric 7 and 7'. The end of the supporting arm identifed by numeral 2' carries the members which form the passages for the separate pieces of fabric and includes an upper plate element 8, an intermediate plate element 9 and a lower plate element 10, all of which are in spaced and vertical alignment and which extend in a plane parallel with the workpiece 3. The passage formed between plate element 8 and 9 is depicted by numeral 11 and the one between plate elements 9 and 10 by numeral 12. The entrances or mouths of the passages 11 and 12 are identified in FIG. 2 by numerals 11' and 12', respectively, and the end 2' of the supporting arm 2 forms the inner surface of each passage so as to define guide walls 13 and 14. These guide walls 13 and 14 are effective in aligning the edges of the separate pieces of fabric and directing the aligned pieces toward the sewing zone.

The upper and lower plate elements 8 and 10 are provided on their leading edges with a curved profile (FIGS. 1 and 3) and intermediate the sewing axis 4 and the end 2' of the supporting arm 2, these curved profiles are formed to extend in the direction of the presser foot 5 and define recesses 15 and 16 in said plate elements 8 and 10 respectively, which have a configuration of bulbous outline. Relative to the dimensions of these recesses 15 and 16, the ratio between their longitudinal length 1' and their mean width 1 is greater than 1:1 which is effective in relieving the stresses set up on the edges of the pieces of fabric 7 and 7' as a result of the pulling force thereon by the feed dogs (not shown) in the direction of the indicating arrow G and by the opposing resistance created while the edges are being unrolled as well as the opposing force created by frictional engagement of said pieces with the plate elements. As shown in FIG. 2, the edges of the curved profiles at the mouths or entrances to the recesses 15 and 16 are tapered as at 15' and 16' in the direction of the passages 11 and 12 respectively.

Figure 1:
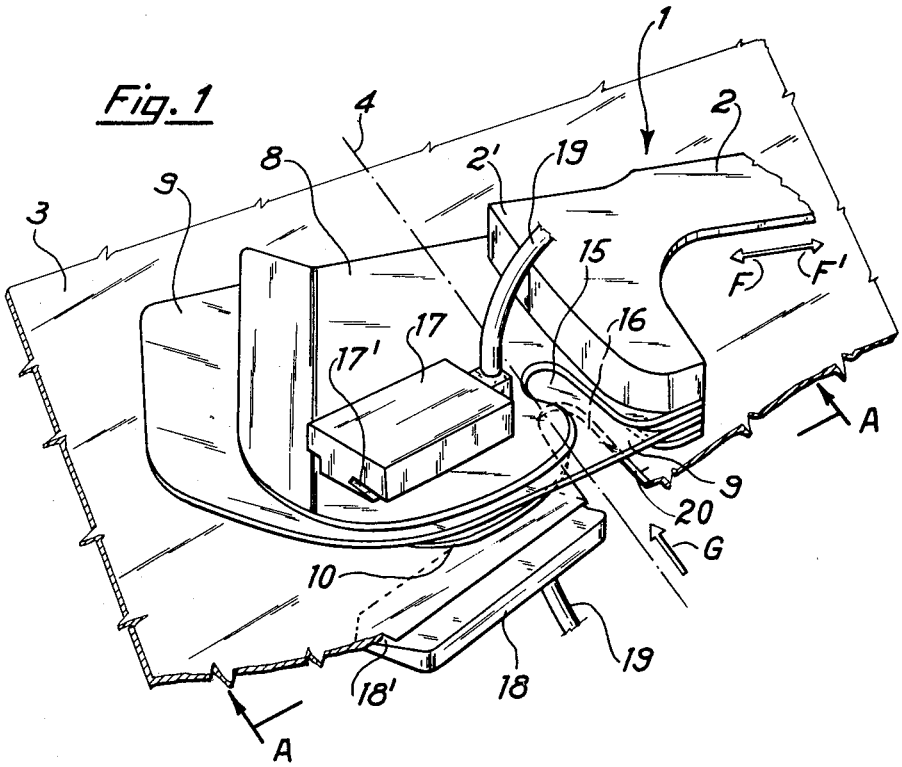
FIG. 1 is a perspective view of the workpiece guide according to the invention showing its associated position with the worksurface of a sewing machine.

Operatively associated with each passage 11 and 12, the workpiece guide 1 is provided with an upper blower device 17 and a lower blower device 18 which as shown in FIGS. 1 and 3 are disposed to the left of the sewing axis 4. These blower devices are connected by means of feedlines 19 to any suitable source of compressed air not shown. The upper blower device 17 is attached to the upper surface of the upper plate element 8 and its opening 17' through which air is emitted is directed in the opposite direction to which the workpiece is caused to advance to the sewing zone. The lower blower device 18 is attached to the underside of the worksurface, and like the upper blower device 17, its opening 18' for emitting air is directed in the same direction.

As shown in FIG. 3, the pieces of fabric 7 and 7' have a tendency to become curled or rolled as at 7'' along their edges which are intended to be joined by seaming and prior to the instant invention, such a condition frequently created a serious condition of preventing proper alignment of said edges and incorrect seaming along the sewing axis. Additionally, such rolling of the edges would frequently initiate a folding of the edges which if drawn into the passages of the guide would prevent them from becoming aligned and because of their increased thickness, they easily become trapped to the extent of causing a cessation of the sewing operation. The workpiece guide according to the invention eliminates these problems by providing a means which automatically unrolls and straightens the curled edges 7 and 7' of the fabric prior to entering their respective passage within said guide. This is accomplished by first subjecting the curled edges to the streams of air emitted from the openings 17' and 18' of the blower devices 17 and 18 respectively and as the pieces advance within their passages in the direction of the sewing zone, the tapered edges 15' and 16' forming the entrance to the recesses 15 and 16 are caused to engage the pieces adjacent to their partially straightened edges and effectively complete the straightening of the edges as they enter the passage to engage their respective guide wall.

It should be noted that the tapered edges 15' and 16' when engaged by the partially unrolled edges of the pieces of fabric provide a plowing action which as said pieces continue their advance toward the sewing zone are effective in completing the straightening of the rolled edges so that they enter the guide in the proper manner. The particular configuration of the recesses 15 and 16 as heretofore described, are effective in releasing the stresses set up in the pieces by the pulling force to which they are subjected by the feed dogs and their frictional engagement with the plate elements that form the passages. Additionally, the worksurface 3 is provided with a longitudinal extending recess 20 that is disposed in relatively close proximity with the recess 16 and serves as a stress release means which permits the curled edge of the lower piece of fabric 7' being unwound to do so in a relaxed state and without being subjected to any impeding force resulting from the action of the tapered edge 16'.

It should be understood that the blower devices 17 and 18 are more essential on pieces of fabric which are of a thin and lightweight construction and that with workpieces fabricated from thicker, and by comparison a relatively stiffer fabric, it is possible that said blower devices may actually be dispensed with, and that adequate uncurling of the edges can be satisfactorily accomplished solely by the tapered edges 15' and 16' of the recesses 15 and 16 respectively. Regardless of this, the guide according to the invention possesses all the operating characteristics necessary to effect unrolling of the edges of pieces of fabric to be joined by seaming, and includes the necessary elements to assure that the pieces are properly extended and aligned as they enter the sewing zone of the machine and these features are all accomplished automatically, at high speed and without the need for manual intervention on the part of the operator.

Although the preferred embodiment has been described as a guide having several passages for separate pieces of fabric, it should be understood that the noval features of this guide could be utilized with guides having a single passage in which a simple seam is formed on a single piece of fabric or it can be utilized with guides adapted to join a plurality of pieces of fabric in which all have the same configuration.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A guide for uncurling and aligning the edges of superposed layers of fabric adjacent the sewing axis and prior to entering the sewing zone of a sewing machine of the type having a presser foot and worksurface, said guide comprising:

(a) a supporting arm (2) mounted on the machine upstream of the sewing zone in spaced and parallel relation with the worksurface;

(b) a pair of plate elements (8, 10) assembled in spaced and vertical alignment in one end (2') of said supporting arm including:

(i) an intermediate plate element (9) assembled between said plate elements (8, 10) defining passages (11, 12) therebetween;

(c) guide walls (13, 14) forming the inner surfaces of said passages (11, 12) for aligning and guiding the layers of fabric in the direction of the sewing axis;

(d) means (17, 18) operatively associated with each of said plate elements for engaging the curled edges of fabric upstream of the guide to effect a partial uncurling thereof; and (e) means (15, 16) forming a part of the leading edge of each said plate elements for completing the uncurling of the fabric edges as they enter the passages of the guide.

2. The guide according to claim 1 wherein said engaging means defines an upper blower device (17) and a lower blower device (18) for directing streams of compressed air in the direction of the curled edges of fabric.

3. The guide according to claim 1 wherein said plate elements include leading edges with curved profiles with said engaging means forming a part thereof and defining recesses (15, 16) with a configuration of bulbous outline extending in the direction of the sewing zone parallel with and adjacent the sewing axis.

4. The guide according to claim 3 wherein the sides defining the entrance to said recesses (15, 16) include tapered edges (15', 16') for engaging the pieces of fabric and straightening the edges thereof partially unrolled by said engaging means.

5. The guide according to claim 4 wherein said tapered edges (15', 16') extend in the direction of passages (11, 12) and form an acute angle with the internal surfaces of said plate elements (15', 16') respectively.

* * * * *